US009412234B2

(12) United States Patent
Hutchinson-Kay

(10) Patent No.: US 9,412,234 B2
(45) Date of Patent: Aug. 9, 2016

(54) CHAIN REACTION

(75) Inventor: Christer Hutchinson-Kay, Taby (SE)

(73) Assignee: VIDEO B HOLDINGS LIMITED, Tortola (VG)

( * ) Notice: Subject to any disclaimer, the term of this patent is extended or adjusted under 35 U.S.C. 154(b) by 1017 days.

(21) Appl. No.: 12/749,208

(22) Filed: Mar. 29, 2010

(65) Prior Publication Data

US 2010/0261522 A1 Oct. 14, 2010

(30) Foreign Application Priority Data

Apr. 8, 2009 (AU) ..... 2009901525

(51) Int. Cl.
*G07F 17/32* (2006.01)

(52) U.S. Cl.
CPC ..... *G07F 17/3272* (2013.01); *G07F 17/32* (2013.01); *G07F 17/3244* (2013.01)

(58) Field of Classification Search
USPC ..... 463/25, 29, 42
See application file for complete search history.

(56) References Cited

U.S. PATENT DOCUMENTS

| | | | | |
|---|---|---|---|---|
| 6,210,276 | B1 * | 4/2001 | Mullins | 463/27 |
| 6,939,229 | B2 * | 9/2005 | McClintic | 463/25 |
| 7,389,989 | B1 | 6/2008 | Hong | |
| 7,666,092 | B2 * | 2/2010 | Kaminkow et al. | 463/25 |
| 2003/0100361 | A1 * | 5/2003 | Sharpless | G07F 17/32 463/25 |
| 2003/0114220 | A1 | 6/2003 | McClintic | |
| 2003/0125107 | A1 * | 7/2003 | Cannon | 463/25 |
| 2003/0199308 | A1 * | 10/2003 | Parker | G07F 17/32 463/20 |
| 2005/0003886 | A1 * | 1/2005 | Englman et al. | 463/25 |
| 2005/0009601 | A1 * | 1/2005 | Manfredi et al. | 463/29 |
| 2006/0040743 | A1 * | 2/2006 | Saffari et al. | 463/42 |
| 2006/0111178 | A1 * | 5/2006 | Gallaway | G07F 17/32 463/25 |
| 2006/0121971 | A1 * | 6/2006 | Slomiany | G07F 17/32 463/16 |
| 2007/0235936 | A1 | 10/2007 | Couri | |
| 2008/0020823 | A1 | 1/2008 | Cuddy et al. | |
| 2008/0036152 | A1 | 2/2008 | Durbin | |
| 2008/0061508 | A1 | 3/2008 | Durbin | |
| 2008/0136103 | A1 | 6/2008 | Feola | |
| 2008/0153564 | A1 | 6/2008 | Baerlocher | |
| 2009/0082099 | A1 * | 3/2009 | Luciano et al. | 463/26 |
| 2009/0245410 | A1 * | 10/2009 | Lee et al. | 375/267 |
| 2009/0270173 | A1 * | 10/2009 | Christensen | 463/42 |
| 2009/0275411 | A1 * | 11/2009 | Kisenwether et al. | 463/42 |

FOREIGN PATENT DOCUMENTS

| | | | |
|---|---|---|---|
| WO | 2006052213 | A1 | 5/2006 |
| WO | 2007030632 | A2 | 3/2007 |
| WO | 2007086779 | A1 | 8/2007 |
| WO | 2007127259 | A2 | 11/2007 |
| WO | 2008024330 | A2 | 2/2008 |

(Continued)

*Primary Examiner* — David L Lewis
*Assistant Examiner* — Shauna-Kay Hall
(74) *Attorney, Agent, or Firm* — Cantor Colburn LLP

(57) ABSTRACT

A method of gaming in a gaming system comprising: initiating a bonus game comprising a plurality of levels having a defined sequence; determining a group of participants in the bonus game; associating each participant with a level such that each participant is eligible to a bonus win based on the level with which the participant is currently associated; awarding a bonus win to one of the participants; and associating a subsequent level with each of the participants in response to the bonus win such that each participant is eligible to a subsequent bonus win based on the subsequent level associated with the participant.

21 Claims, 6 Drawing Sheets

(56) References Cited

FOREIGN PATENT DOCUMENTS

| | | | |
|---|---|---|---|
| WO | 2008039892 | A2 | 4/2008 |
| WO | 2008045398 | A2 | 4/2008 |
| WO | 2008051796 | A2 | 5/2008 |
| WO | 2008057098 | A1 | 5/2008 |
| WO | 2008063395 | A2 | 5/2008 |
| WO | 2008133850 | A1 | 11/2008 |
| WO | 2008137878 | A2 | 11/2008 |

* cited by examiner

CHAIN REACTION

RELATED APPLICATIONS

This application claims priority to Australian Provisional Patent Application No. 2009901525, having a filing date of Apr. 8, 2009, which is hereby incorporated by reference herein in its entirety.

FEDERALLY SPONSORED RESEARCH OR DEVELOPMENT

[Not Applicable]

[MICROFICHE/COPYRIGHT REFERENCE]

[Not Applicable]

BACKGROUND OF THE INVENTION

The invention relates to a method of gaming, a gaming system and a bonus game controller.

There are a number of existing gaming systems where players of a set of gaming machines arranged in a bank are eligible to win a prize controller by a common controller.

While such gaming systems provide players with enjoyment, a need exists for alternative gaming systems in order to maintain or increase player enjoyment.

BRIEF SUMMARY OF THE INVENTION

In a first aspect, the invention provides a method of gaming in a gaming system comprising:

initiating a bonus game comprising a plurality of levels having a defined sequence;

determining a group of participants in the bonus game;

associating each participant with a level such that each participant is eligible to a bonus win based on the level with which the participant is currently associated;

awarding a bonus win to one of the participants; and associating a subsequent level with each of the participants in response to the bonus win such that each participant is eligible to a subsequent bonus win based on the subsequent level associated with the participant.

In an embodiment, the method comprises initiating the bonus game in response to forming a group of participants.

In an embodiment, the method comprises applying at least one criterion to the formation of the group.

In an embodiment, at least one criterion is that a bet amount satisfies a bet criterion.

In an embodiment, at least one criterion is that at least a threshold number of participants will participate in the group.

In an embodiment, determining the group comprises allowing at least one participant to join the game after the game has been initiated.

In an embodiment, each participant initially participates in the bonus game at a first level, such that joining participants will remain behind in the sequence relative to any other participants already on a subsequent level in the sequence.

In an embodiment, each participant is always eligible for the same level and joining participants are subject to at least one additional bet criterion.

In an embodiment, the method comprises determining from the current group of participants whether or not a new participant can join the group.

In an embodiment, at least one participant is a gaming device.

In an embodiment, at least one participant is an identified player.

In an embodiment, the method comprises associating each participant with a level in a data structure and updating the data structure to associate a subsequent level with each of the participants in response to the bonus win.

In an embodiment, awarding a bonus win to one of the participants is performed by a bonus controller.

In an embodiment, the bonus controller performs the association of participants with levels.

In an embodiment, wherein the bonus controller performs the initiation of the bonus game.

In an embodiment, the bonus controller performs the determination of the group.

In an embodiment, the method comprises displaying the level associated with each participant on one or more displays.

In a second aspect, the invention provides a gaming system arranged to:

initiate a bonus game comprising a plurality of levels having a defined sequence;

determine a group of participants in the bonus game;

associate each participant with a level such that each participant is eligible to a bonus win based on the level with which it is currently associated;

award a bonus win to one of the participants; and associate a subsequent level with each of the participants in response to the bonus win such that each participant is eligible to a subsequent bonus win based on the subsequent level associated with the participant.

In an embodiment, the gaming system comprises a bonus game controller and a plurality of gaming devices in data communication with the bonus game controller.

In an embodiment, the bonus controller initiate the bonus game, determines a group, and controls the level currently associated with each participant.

In an embodiment, the bonus controller initiates the bonus game in response to forming a group of participants.

In an embodiment, the bonus controller applies at least one criterion to the formation of the group.

In an embodiment, at least one criterion is that a bet amount satisfies a bet criterion.

In an embodiment, at least one criterion is that at least a threshold number of participants will participate in the group.

In an embodiment, at least one participant is a gaming device.

In an embodiment, at least one participant is an identified player of one of the gaming devices.

In an embodiment, the gaming system is configured to allow at least one participant to join the game after the game has been initiated.

In an embodiment, each participant initially participates in the bonus game at a first level, such that joining participants will remain behind in the sequence relative to any other participants already on a subsequent level in the sequence.

In an embodiment, each participant is always eligible for the same level and the gaming system subjects joining participants to at least one additional bet criterion.

In a third aspect, the invention provides a bonus game controller for a gaming system, the bonus game controller arranged to:

initiate a bonus game comprising a plurality of levels having a defined sequence;

determine a group of participants in the bonus game;

associate each participant with a level such that each participant is eligible to a bonus win based on the level with which it is currently associated; and associate a subsequent level with each of the participating participants in response to the bonus win such that each participant is eligible to bonus win based on the subsequent level associated with the participant.

In an embodiment, the bonus game controller is further arranged to award the bonus win to one of the participants.

In an embodiment, the bonus controller initiates the bonus game in response to forming a group of participants.

In an embodiment, the bonus controller applies at least one criterion to the formation of the group.

In an embodiment, at least one criterion is that a bet amount satisfies a bet criterion.

In an embodiment, at least one criterion is that at least a threshold number of participants will participate in the group.

In an embodiment, at least one participant is a gaming device.

In an embodiment, at least one participant is an identified player of one of the gaming devices.

In an embodiment, the bonus game controller is configured to allow at least one participant to join the game after the game has been initiated.

In an embodiment, each participant initially participates in the bonus game at a first level, such that joining participants will remain behind in the sequence relative to any other participants already on a subsequent level in the sequence.

In an embodiment, each participant is always eligible for the same level and, the bonus controller subjects joining participants to at least one additional bet criterion.

In a fourth aspect, the invention provides computer program code which when executed implements the above method.

In a fifth aspect, the invention provides a computer readable medium comprising the above program code.

In a sixth aspect, the invention provides a data signal comprising the above program code.

In a seventh aspect, the invention extends to transmitting the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
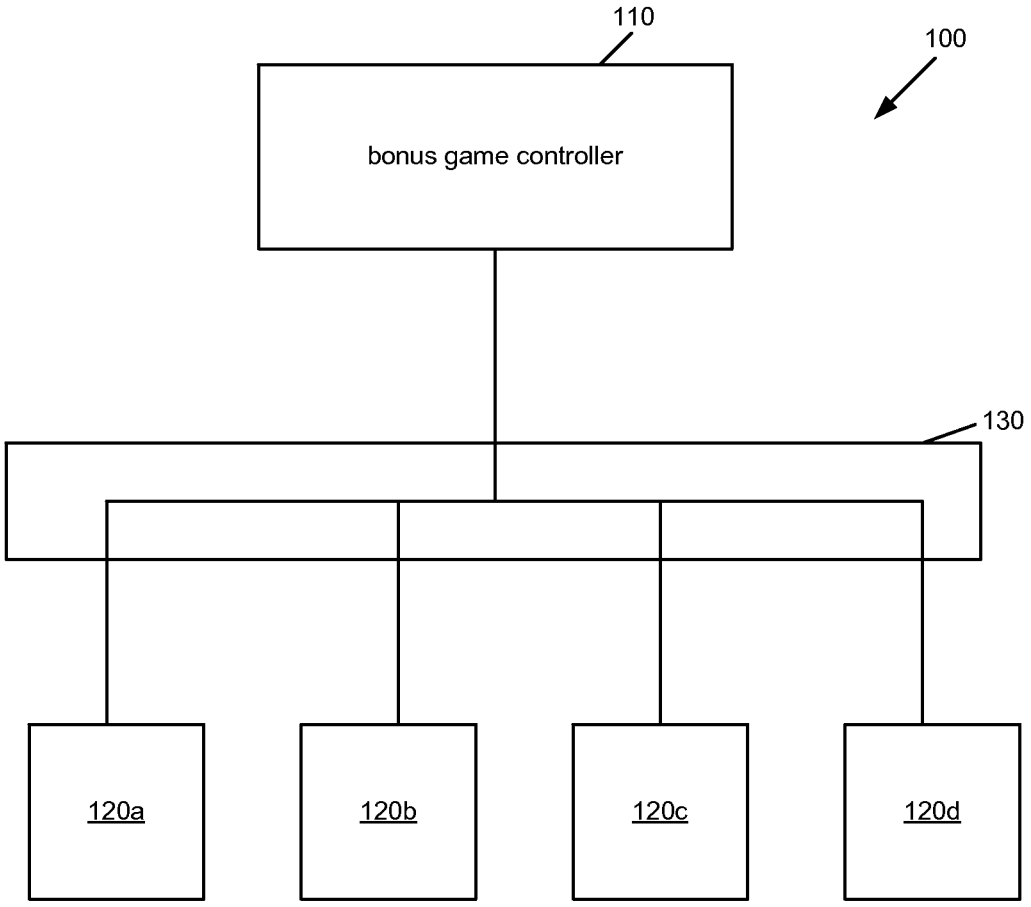
FIG. 1 is a block diagram of a gaming system.

Referring to the drawings, there is shown a gaming system having a bonus controller arranged to implement a bonus game having a number of levels. In an embodiment, when a player has a bonus win at a level, all participating players go up a level such that any subsequent win will be at their respective new level.

General System Configuration

Depending on the embodiment, the gaming system may take a number of different forms. In one form, shown in FIG. 1, the gaming system 100, includes a bonus controller 110. The bonus controller 110 is in data communication with a plurality of gaming devices 120 over a network 130.

Figure 5:
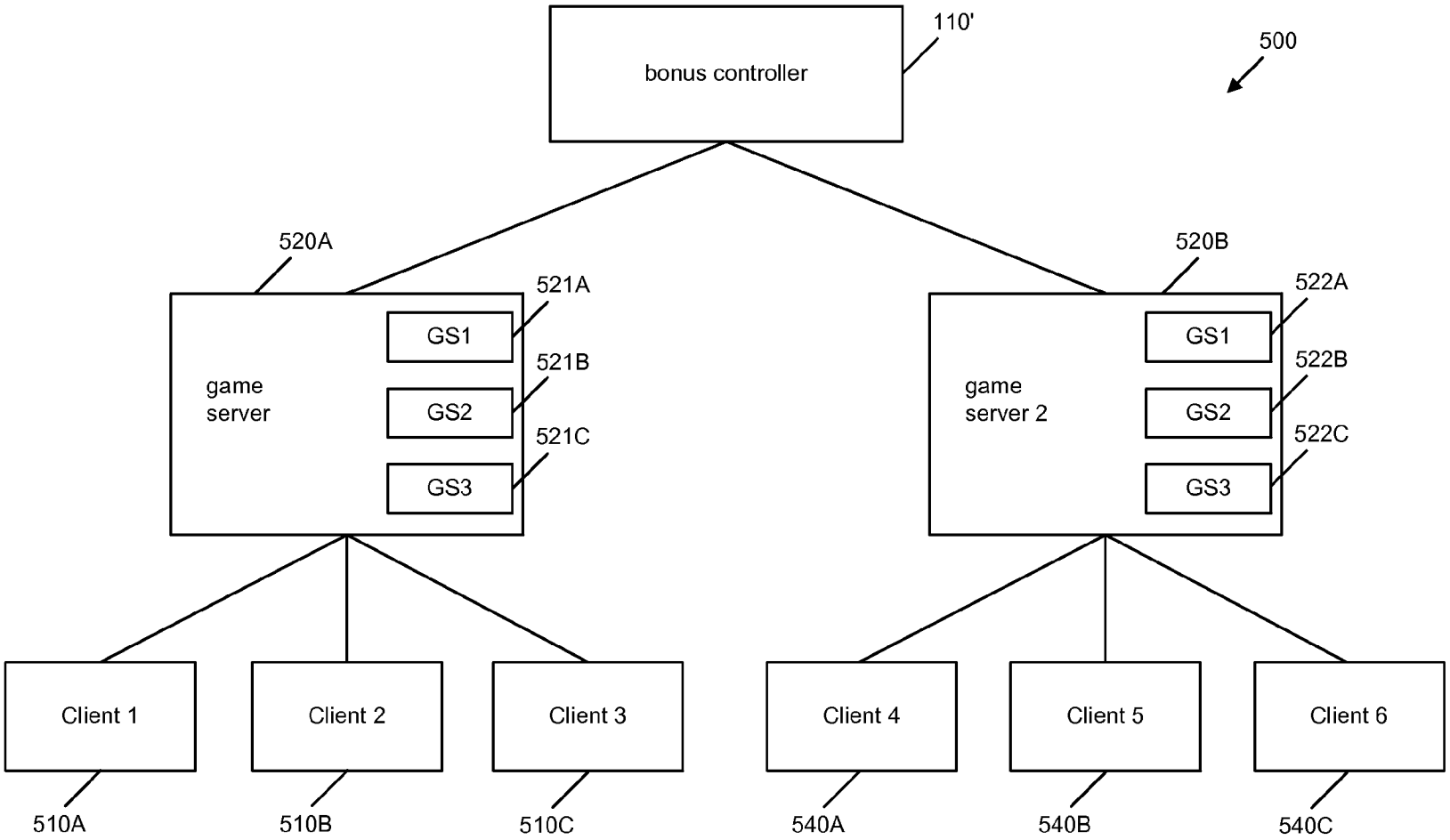
FIG. 5 is a block diagram of a server based gaming system.

In another form shown in FIG. 5, the gaming system comprises a plurality of gaming devices in the form of gaming clients 510,540. A first group of clients 510A,510B,510C are connected to a first game sever 520A which implements a game session 521A,521B,521C for each client. A second group of clients 540A,540B,540C are connected to a second game sever 520B which implements a game session 522A, 522B,522C for each client. The first and second game servers 520 are connected to a bonus controller 110' such that participating gaming clients of either server 520A,520B can play the bonus game. The bonus controller 110 is another server arranged to implement aspects of the bonus game.

Gaming Devices

Herein, the term gaming device is used to refer to any device used by a player to play a game and specifically includes stand alone gaming machines and interactive video terminals which implement games in a client/server architecture.

Figure 2:
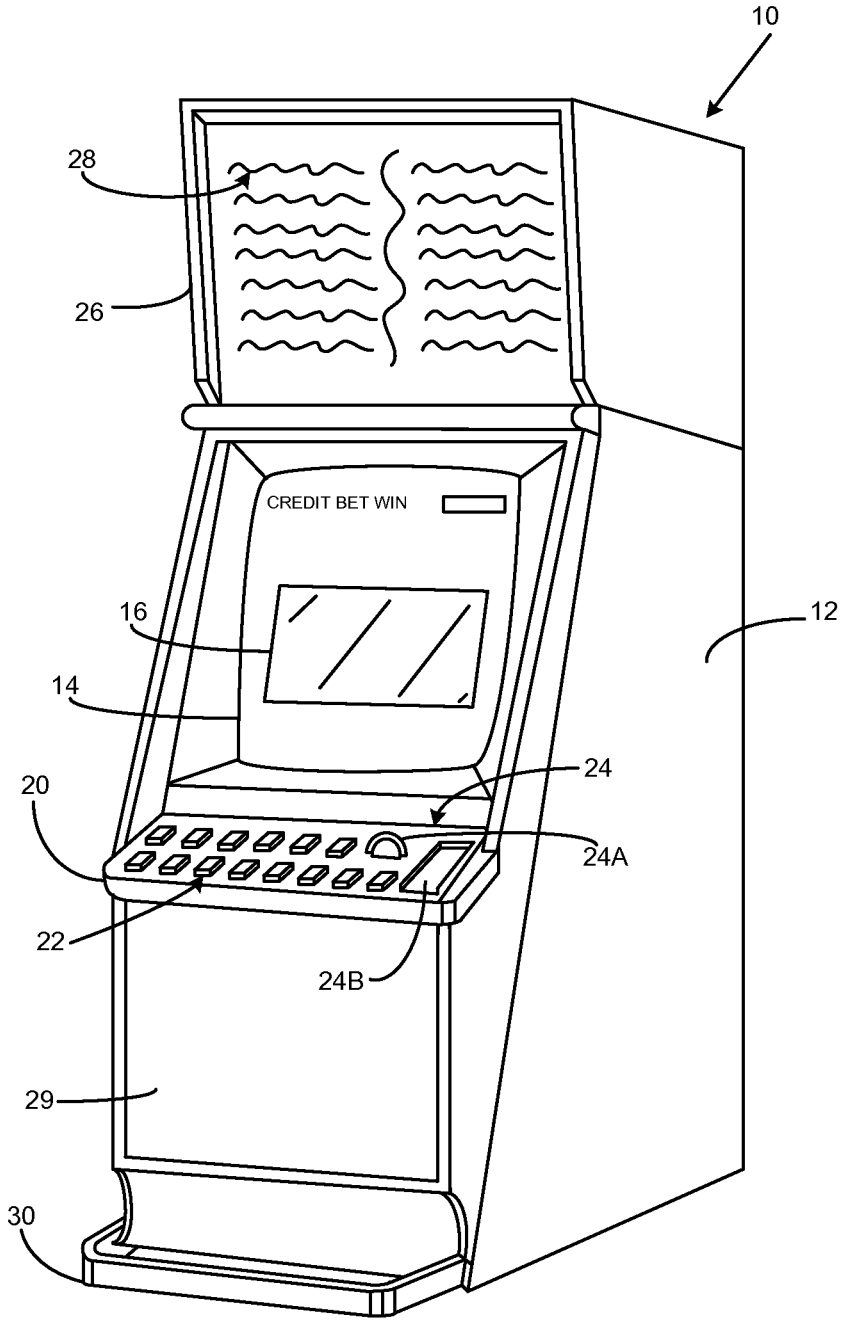
FIG. 2 is a perspective view of a gaming device in the form of a stand alone gaming machine.

A gaming device in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module comprising a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
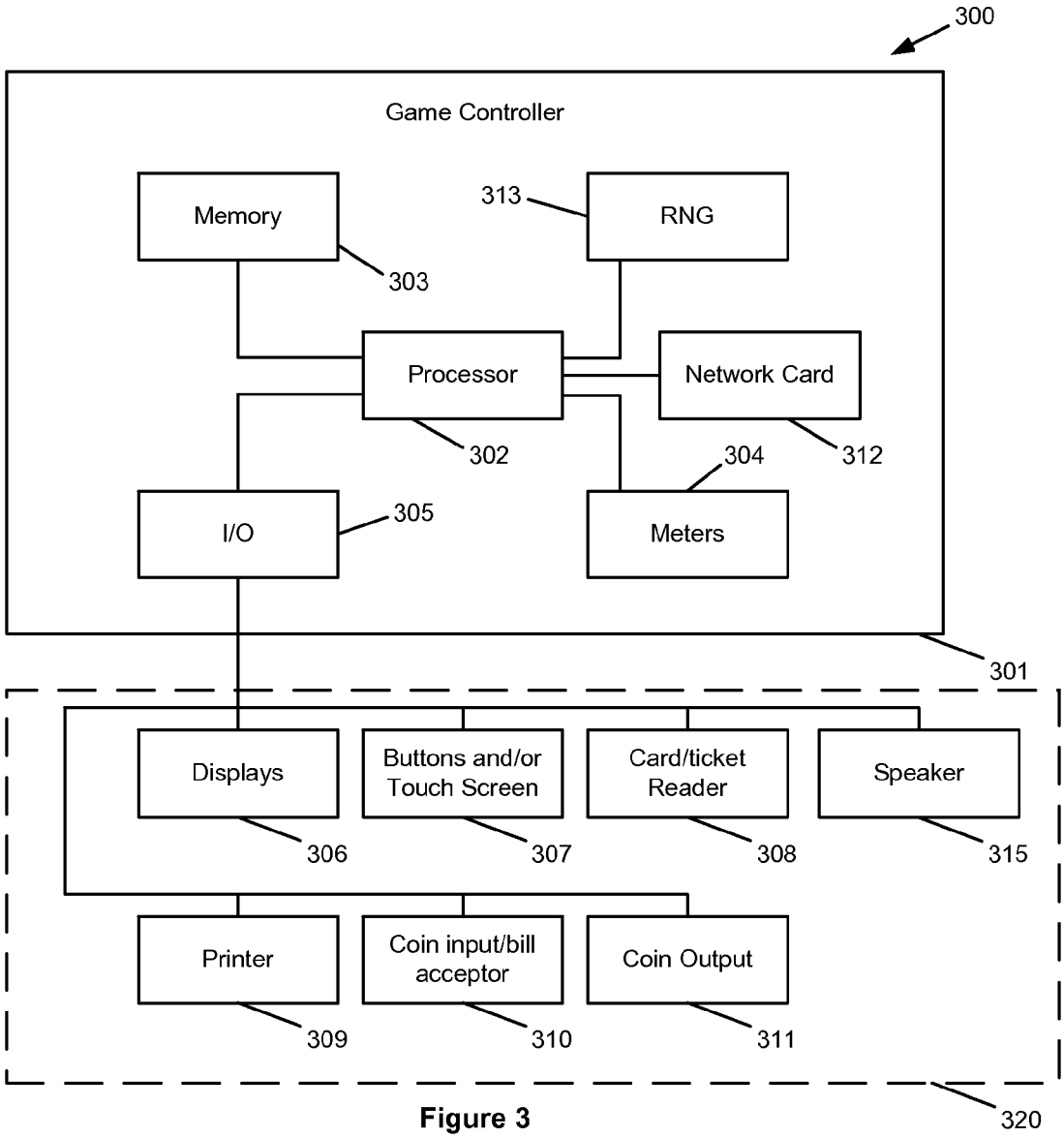
FIG. 3 is a block diagram of the functional components of a gaming machine.

FIG. 3 shows a block diagram of operative components of a typical gaming machine 300 which may be the same as or different to the gaming machine of FIG. 2.

The gaming machine 300 includes a game controller 301 having a processor 302. Instructions and data to control operation of the processor 302 are stored in a memory 303, which is in data communication with the processor 302. Typically, the gaming machine 300 will include both volatile and non-volatile memory and more than one of each type of memory, with such memories being collectively represented by the memory 303.

The gaming machine 300 has hardware meters 304 for purposes including ensuring regulatory compliance and monitoring player credit, an input/output (I/O) interface 305 for communicating with peripheral devices of the gaming machine 300. The input/output interface 305 and/or the peripheral devices may be intelligent devices with their own memory for storing associated instructions and data for use with the input/output interface or the peripheral devices. A random number generator module 313 generates random numbers for use by the processor 302. Persons skilled in the art will appreciate that the reference to random numbers includes pseudo-random numbers.

In the example shown in FIG. 3, a player interface 320 includes peripheral devices that communicate with the game controller 301 comprise one or more displays 306, a game play mechanism is provided by buttons and/or a touch screen 307, a card and/or ticket reader 308, a printer 309, a bill acceptor and/or coin input mechanism 310, a coin output mechanism 311 and at least one speaker 315. Additional hardware may be included as part of the gaming machine 300, or hardware may be omitted as required for the specific implementation. For example, while touch screens and/or buttons are suitable input devices for gaming machines, other input devices may be employed.

The game controller 301 determines based on game rules stored in memory 303, the outcomes of games including whether to award a win to a player.

In addition, the gaming machine 300 may include a communications interface, for example a network card 312. The network card may, for example, send status information, accounting information or other information to a central controller, server or database and receive data or commands from the central controller, server or database.

Figure 4:
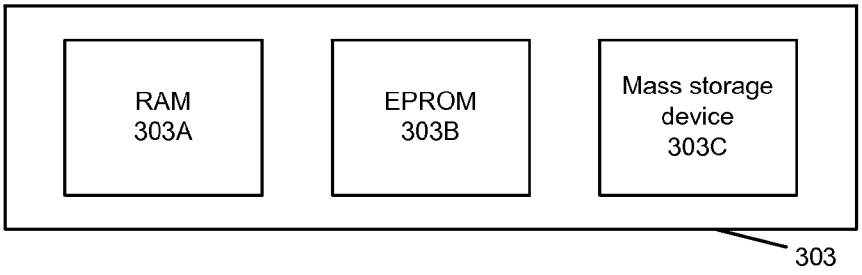
FIG. 4 is a schematic diagram of the functional components of a memory.

FIG. 4 shows a block diagram of the main components of an exemplary memory 303. The memory 303 includes RAM 303A, EPROM 303B and a mass storage device 303C. The RAM 303A typically temporarily holds program files for execution by the processor 302 and related data. The EPROM 303B may be a boot ROM device and/or may contain some system or game related code. The mass storage device 303C is typically used to store game programs, the integrity of which may be verified and/or authenticated by the processor 302 using protected code from the EPROM 303B or elsewhere.

It is also possible for the operative components of the gaming machine 300 to be distributed, for example input/output devices 306,307,308,309,310,311 to be provided remotely from the game controller 301.

A gaming device as indicated above may also be a gaming client of a client/server architecture where a portion of the game is executed on the client and a portion of the game is executed on the server. In such embodiments, the client typically takes the form of an interactive video terminal which has a similar outward appearance to the gaming machine described above but the terminal is only responsible for limited functions, for example rendering graphically game outcomes generated by a server. Further detail of a client/server gaming architecture may be found in WO 2006/052213 and WO 2007/086779, the disclosures of which are incorporated herein by reference.

Further Detail of Gaming System and Method

Figure 7:
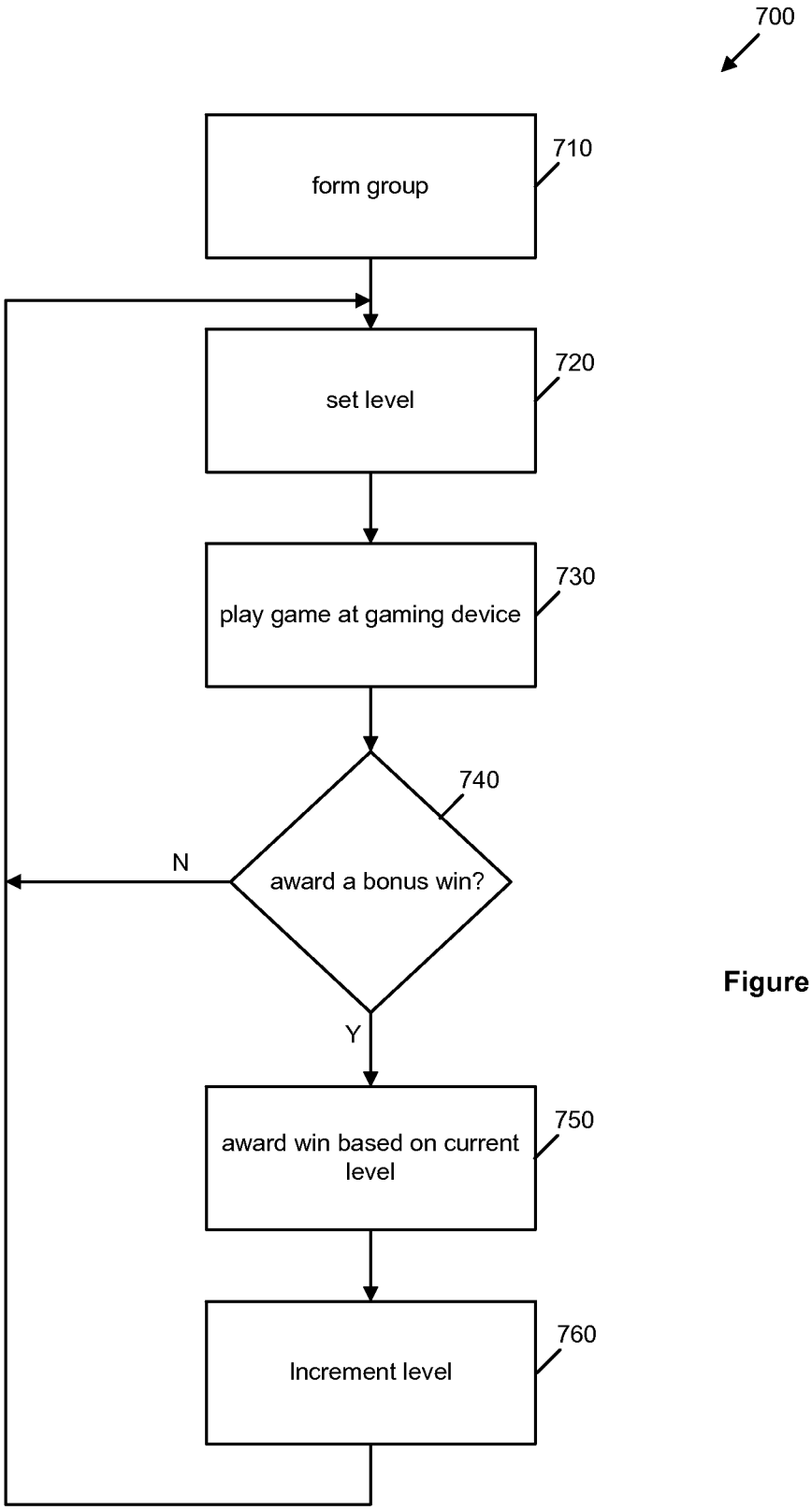
FIG. 7 is a flow chart of a method of an embodiment.

Referring to FIG. 7, the method 700 of the embodiment involves the bonus controller forming 710 a group of gaming devices to participate in the game for the purpose of seeking bonuses. The participants in the group can be determined in a number of different ways. For example, in a Casino based setting, the members of the group can be determined from the players playing a group of physically co-located gaming devices (e.g. a bank of machines) who meet a criteria such as that they are playing the maximum bet or are playing an ante bet on the game. In one embodiment, the gaming system treats the gaming devices as the participants in the game. In other embodiments, where the identity of one or more players is known, the player is treated as the participant.

In a server based gaming system similar criteria may be employed or players may search for a group or register for group play. In such a system, a group may be formed across a number of different venues.

Once a group is formed, an initial level is set 720 for the bonus game by the bonus controller which initiates the bonus game. The players then play 730 the game which is on offer with their gaming device. Depending on the embodiment, the game may be same for all participating gaming devices or there may be a number of different games which are available.

As described above, groups are formed for the purpose of seeking bonuses. During normal play of games on the gaming devices the players win in accordance with the normal rules of the game being played on the gaming device. In one embodiment, each of the gaming devices (or game instances in the case of the server based gaming) is arranged to determine whether to award a bonus win 740. The award of a bonus win can be, for example the award of a feature game, such as a set of free spins or a second screen feature game.

The method 700 then involves incrementing 760 the level for the each of the participating gaming devices in the group. The person skilled in the art will appreciate that by incrementing the level for each gaming device that the gaming system is effectively incrementing the level for the participating players. In the embodiment, with each increase in the bonus level, the bonus wins are increased. For example, if the bonus involves the award of free spins, the number of free spins can be increased, for example, by five spins per level. In another example bonus wins can be increased by a defined factor, for example two. In one embodiment, where an ante-bet is employed, the cost of participation in the group game can increase for each level. In one embodiment, ranges of awards may be available at each level. In this embodiment at least the upper boundary of a range of possible wins is increased.

Figure 6:
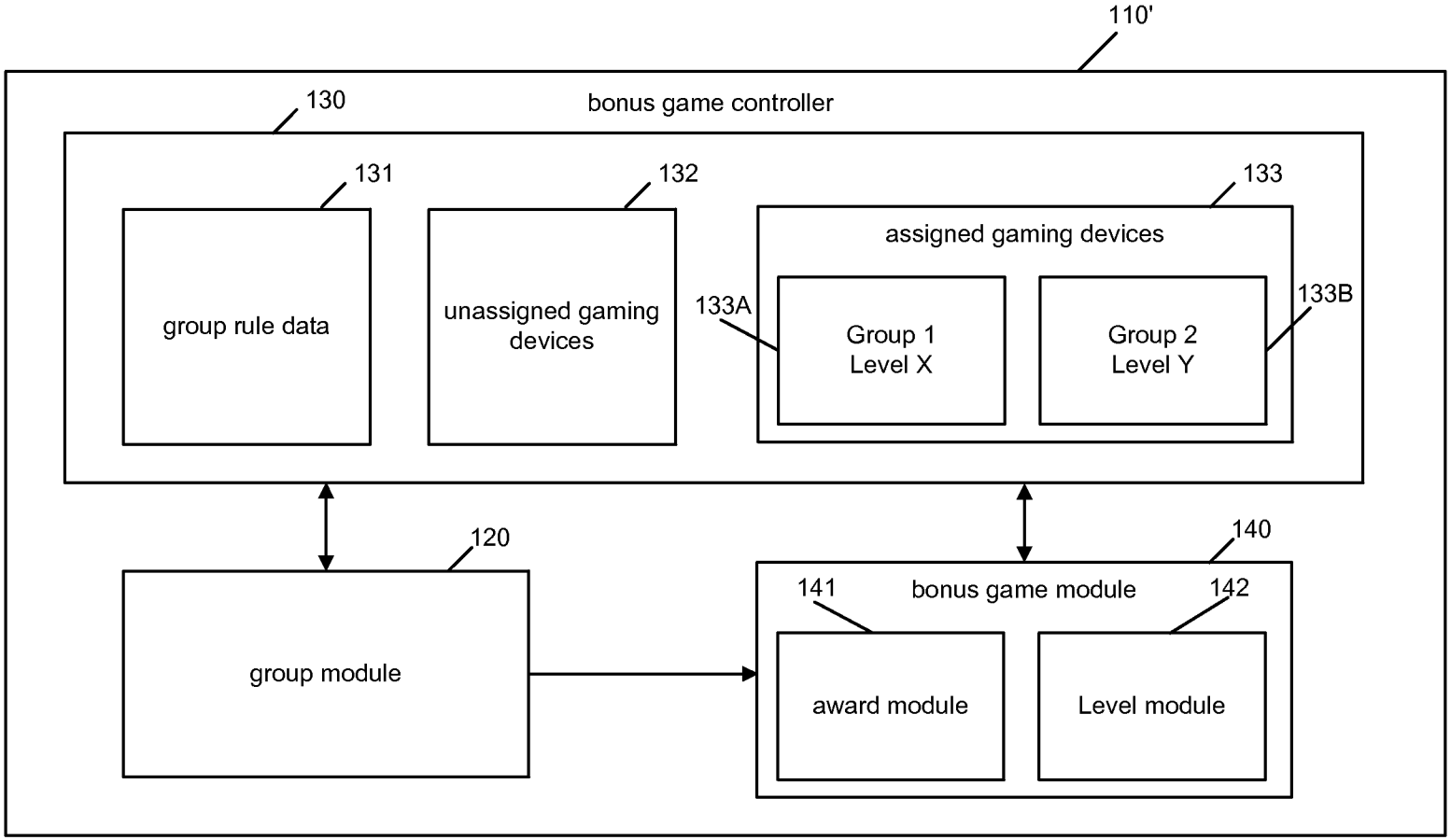
FIG. 6 is a block diagram of a bonus game controller.

Referring to FIG. 6, there is an example of the bonus game controller 110' suitable for use in a server based gaming system such as that shown in FIG. 5.

Requests to participate in the group are handled by the group module 120. Group module is arranged to implement group rule data 131 stored in memory 130 of the bonus game controller 110' to control the manner in which groups are formed, for example, membership of a group can be limited to a bank of a gaming devices, to a particular area of a venue, particular casino, particular owner, a geographical area etc. In a server based game, the player operates the input devices of their gaming device to indicate that they wish to participate in a group game. Depending on the implementation, the player operates their gaming device to either ask for a list of players that want to participate or to indicate that they want to be added to a group. In the former option, the group module 120 evaluates what groups the player is eligible to join and players contact one another using a messaging service within the gaming system in order to establish a group. This mode of operation is advantageously suited to instances where players wish to participate with people they know in a gaming community.

Alternatively, the grouping is conducted by the group module 120. To this end, the group module 120 maintains a list of unassigned gaming devices 132 as groups are being formed. The group module 120 applies participation criteria to determine a set of gaming devices amongst the unassigned gaming devices to form a group. One participation criterion may be that the number of gaming devices is at least a minimum number, for example, 2, 4, 10. Another criterion for participation may be that players are playing a side bet or maximum bet as described above. Once the group is formed, the group module 120 stores the group in an assigned gaming device data structure 133 in memory 130.

The assigned gaming devices data structure 133 stores the groups including the identity of each participating gaming device (or player) and the current level of each gaming device in the group which may be the same or different depending on the embodiment. Accordingly, as shown by way of example in FIG. 6 the assigned gaming devices may include First Group at Level X 133*a* and a Second Group at Level Y 133*b*.

During play, each participating game device plays a game from which the player can win a bonus award corresponding to the current level. The games may be the same or different but advantageously each have a fair chance of winning an award of a bonus level. A top box of the gaming device can be configured to display the outcomes being achieved on other gaming devices in the group. In one embodiment, this may be optional and set by the players of specific gaming devices. During play, it may be possible to use a messaging service to chat with other players in the group. When a player wins a bonus win, the win is shown to all players of the group so that everyone knows that the next bonus win will be increased. That is, each player is moved to the next level in the sequence. In one embodiment, the game replay is shown on the top screen for all players in the group.

In one embodiment, players may be allowed to join the group after a group has been playing for some time. There may be conditions for allowing the player to join the group. For example, in one embodiment, the existing players of the group may get to decide whether a player joins the group. In another embodiment, the player may be required to place some additional form of wager to join the group.

In one example, the group may be playing at a third level of the bonus game. When a new player seeks to enter the game, the player enters the third level. In this example the new player plays with the same number of credits as the players of the group. In another example, the player plays at the same level but must play an increased number of credits (i.e. a larger wager) until the player reaches the same level of wage credits as the other players in the group.

In an alternative example, each new player level enters at level 1. Such players will then move up the levels in lock step with the other players such that if when the new player joins, the group is at level 3, when the group advances to level 4, the new player will go to level 2 and when the group goes to level 5 the new player will go to level 3.

In some embodiments the gaming system may be configured so that the player that won the previous level obtains some additional benefit, for example a percentage of the award made to the next player who has a bonus win.

Referring again to FIG. 6, bonus game controller 110' includes a bonus game module 140 which is designed to control the levels and awards. Accordingly level module 142 updates the data in the assigned gaming device data structure 133 to indicate the current level of each gaming machine. In one embodiment, the award module 141 makes the award when the bonus is won. For example, if the awards are prize amounts, the bonus awards can be made by the bonus controller 110'. (Such an embodiment is particularly useful when a bonus controller is employed in conjunction with stand alone gaming machines as the stand alone gaming machines themselves need not know what level they are on.) In other embodiments, the level module 142 communicates to the game servers 520 and specifically to each game session 521, 522 which level the gaming device is currently participating in such that the game session 521,522 can make the awards at the right level. Other embodiments will be apparent to persons skilled in the art.

In addition to the above it will be apparent that various limitations can be placed on the game. For example, the game may be only available during a limited time frame or a new game may be started every hour or the like such that players can only progress to certain levels in that time. Limits can be placed on the number of players participating in the group. An upper limit can be placed on the number of levels such that the game resets once the top level is reached. Alternatively, the game may plateau at a top level after a period of time. Other variations will be apparent to persons skilled in the art.

In the above embodiment, gaming devices are described as being the participant in the game. Such an embodiment suits anonymous play. However persons skilled in the art will appreciate that in some embodiments, the players of the gaming machines may be identified, for example, via a player tracking or loyalty system. In such embodiments, awards may be made in other ways, for example, directly to a player account. Thus, where a player is identified, the player rather than the gaming device may be considered to be the participant. Persons skilled in the art will appreciate that it is possible for there to be embodiments where there are both identified and anonymous players such that both gaming devices and players may be treated as participants by the game.

Further aspects of the method will be apparent from the above description of the gaming system. Persons skilled in the art will also appreciate that the method could be embodied in program code. The program code could be supplied in a number of ways, for example on a tangible computer readable medium, such as a disc or a memory (for example, that could replace part of memory 103) or as a data signal (for example, by downloading it from a server).

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of operating a computerized gaming system being in data communication with a plurality of gaming devices and comprising a processor-based bonus controller, the method comprising:

responsive to participation requests received by the bonus controller from gaming devices among the plurality of gaming devices, determining by the bonus controller two or more gaming devices matching to at least one criterion stored in a memory comprised in the bonus controller;

generating by the bonus controller a participation group of gaming devices, the group constituted by gaming devices issued participations requests and determined as matching to the at least one criterion;

associating, using the bonus controller, each gaming device in the group with one of a plurality of sequential bonus levels, and maintaining in the memory a data structure comprising data indicative of associated bonus levels, wherein said associating associates at least one gaming device in the group with a bonus level that is different from the bonus level of at least one other gaming device in the group; and responsive to receiving from at least one of the gaming devices in the group data indicative of awarding a bonus win in a game running on the at least one gaming device:

updating the data structure by incrementing, for each given gaming device in the group, a bonus level associated with the given gaming device to a respective subsequent bonus level characterized by an increased amount of a bonus win in a game running on the given gaming device; and communicating, from the bonus controller to each of the gaming devices in the group, data indicative of an updated bonus level of a given gaming device, thereby enabling in the game running on a given gaming device increased amount of the bonus win in accordance with the updated bonus level associated with the given gaming device.

2. A method as claimed in claim 1, and fhrther comprising initiating a bonus game in response to said generating the participation group of gaming devices.

3. A method as claimed in claim 2, wherein generating the group comprises allowing at least one gaming device to join the group after the bonus game has been initiated.

4. A method as claimed in claim 3, and wherein each gaming device of the group initially participates in the bonus game at a first bonus level, such that joining gaming devices will remain behind in the sequence relative to any other gaming devices already on a subsequent bonus level in the sequence.

5. A method as claimed in claim 3, and fhrther comprising determining whether a new gaming device can join the group in accordance with the currently generated participation group of gaming devices.

6. A method as claimed in claim 1, and wherein said at least one criterion is a bet criterion.

7. A method as claimed in claim 1, and wherein said at least one criterion is a threshold number of gaming devices in the group.

8. A method as claimed in claim 1, further comprising communicating by the bonus controller data indicative of respective bonus levels associated with each gaming device for displaying on one or more displays.

9. A gaming system configured to be in data communication with a plurality of gaming devices each adapted to award bonus win for a game it runs, the gaming system comprising a processor-based bonus controller configured to:

responsive to participation requests received from gaming devices among the plurality of gaming devices, determine two or more gaming devices matching to at least one criterion stored in a memory comprised in the gaming system;

generate a participation group of gaming devices, the group constituted by gaming devices issued participations requests and determined as matching to the at least one criterion;

associate each gaming device in the group with one of a plurality of sequential bonus levels, wherein said associating associates at least one gaming device in the group with a bonus level that is different from the level of at least one other gaming device in the group;

to maintain in the memory a data structure comprising data indicative of associated bonus levels, and responsive to receiving from at least one of the gaming device in the group data indicative of awarding a bonus win in a game running on the at least one gaming device:

to update the data structure by incrementing, for each given gaming device in the group, a bonus level associated with the given gaming device to a respective subsequent level characterized by an increased amount of a bonus win in a game running on the given gaming device; and to communicate to each of the gaming device in the group, data indicative of an updated bonus level of a given gaming device, thereby enabling in the game running on the given gaming device increased amount of the bonus win in accordance with the updated bonus level associated with the given gaming device.

10. A gaming system as claimed in claim 9, and wherein the bonus controller further configured to initiate a bonus game.

11. A gaming system as claimed in claim 10, and wherein the bonus controller configured to initiate the bonus game in response to said generating the participation group of the gaming devices.

12. A gaming system as claimed in claim 11, wherein the bonus controller is configured to allow at least one gaming device to join the group after the bonus game has been initiated.

13. A gaming system as claimed in claim 12, and wherein each gaming device in the group initially participates in the bonus game at a first bonus level, such that joining gaming devices will remain behind in the sequence relative to any other gaming devices already on a subsequent bonus level in the sequence.

14. A gaming system as claimed in claim 9, and wherein said at least one criterion is a bet criterion.

15. A gaming system as claimed in claim 9, and wherein said at least one criterion is a threshold number of gaming devices in the group.

16. A bonus controller for a computerised gaming system being in data communication with a plurality of gaming devices, the bonus game controller comprising a processor operatively coupled to a memory, the processor is configured to:

responsive to participation requests received from gaming devices among the plurality of gaming devices determine two or more gaming devices matching to at least one criterion stored in the memory;

generate a participation group of gaming devices, the group constituted by gaming devices issued participations requests and determined as matching to the at least one criterion;

associate each gaming device in the group with one of a plurality of sequential bonus levels, wherein said associating associates at least one gaming device in the group with a bonus level that is different from the bonus level of at least one other gaming device in the group;

maintain a data structure stored in the memory and comprising data indicative of associated bonus levels;

responsive to receiving from at least one of the gaming devices in the group data indicative of awarding a bonus win in a game running on the at least one gaming device:

update the data structure by incrementing, for each given gaming device in the group, a bonus level associated with the given gaming device to a respective subsequent level characterized by an increased amount of a bonus win in a game running by the given gaming device; and communicate to each of the gaming device in the group, data indicative of an updated bonus level of a given gaming device, thereby enabling in the game running on the given gaming device increased amount of the bonus win in accordance with the updated level associated with the given gaming device.

17. A bonus controller as claimed in claim 16, and wherein the bonus controller configured to initiate a bonus game in response to said generating the participation group of gaming device.

18. A bonus controller as claimed in claim 17, and further configured to allow at least one gaming device to join the group after the bonus game has been initiated.

19. A bonus controller as claimed in claim 18, and wherein each gaming device of the group initially participates in the bonus game at a first level, such that joining gaming device will remain behind in the sequence relative to any other gaming device already on a subsequent level in the sequence.

20. A bonus controller as claimed in claim 16, and wherein said at least one criterion is a bet criterion.

21. A bonus controller as claimed in claim 16, and wherein said at least one criterion is a threshold number of gaming devices in the group.

* * * * *